US008266724B2

(12) United States Patent
Grilliot et al.

(10) Patent No.: US 8,266,724 B2
(45) Date of Patent: Sep. 18, 2012

(54) HELMET EQUIPPED WITH EYE SHIELD AND WITH FACE-CONFORMABLE GASKET ALONG EDGE PORTION OF EYE SHIELD

(75) Inventors: William L. Grilliot, Dayton, OH (US); Mary I. Grilliot, Dayton, OH (US)

(73) Assignee: Morning Pride Manufacturing, L.L.C., Dayton, OH (US)

( * ) Notice: Subject to any disclaimer, the term of this patent is extended or adjusted under 35 U.S.C. 154(b) by 156 days.

(21) Appl. No.: 11/580,970

(22) Filed: Oct. 13, 2006

(65) Prior Publication Data

US 2008/0109927 A1 May 15, 2008

(51) Int. Cl.
*A42B 1/24* (2006.01)

(52) U.S. Cl. ..... 2/422

(58) Field of Classification Search ..... 2/410, 5, 2/424, 15, 440, 422

See application file for complete search history.

(56) References Cited

U.S. PATENT DOCUMENTS 3,383,155 A 5/1968 Bourke
5,341,516 A * 8/1994 Keim ..... 2/452
5,435,006 A * 7/1995 Kitayama ..... 2/15
5,533,207 A * 7/1996 Diaz ..... 2/10
5,615,413 A * 4/1997 Bower ..... 2/10
5,937,439 A * 8/1999 Barthold et al. ..... 2/10
D422,621 S * 4/2000 Williams ..... D16/339
6,490,729 B1 * 12/2002 Dondero ..... 2/10

* cited by examiner

*Primary Examiner* — Shaun R Hurley
*Assistant Examiner* — Andrew Sutton
(74) *Attorney, Agent, or Firm* — Wood, Phillips, Katz, Clark & Mortimer

(57) ABSTRACT

A helmet for a firefighter or for an industrial, chemical, or emergency rescue worker has a crown and a brim projecting forwardly from the crown. The helmet is equipped with a pair of eye shields, each of which is mounted to the helmet, each of which is adapted to be manually moved between a storage position and a usage position, and each of which in the usage position, but not in the storage position, projects downwardly so as to shield an associated one of the eyes of a wearer. The helmet is equipped with a pair of face-conformable gaskets, each of which is disposed along an outer edge of an associated one of the pair of eye shields and which is adapted to conform to the face of a wearer when the associated one of the pair of eye shields is moved into the usage position. Each face-conformable gasket is made from an elastomeric material, such as neoprene, and has a bladder, which is adapted to conform to the face of the wearer, and a grooved channel, to which the bladder is attached and into which the outer edge of the associated one of the pair of eye shields fits tightly but removably.

14 Claims, 1 Drawing Sheet

HELMET EQUIPPED WITH EYE SHIELD AND WITH FACE-CONFORMABLE GASKET ALONG EDGE PORTION OF EYE SHIELD

TECHNICAL FIELD OF THE INVENTION

This invention pertains to a helmet for a firefighter or for an industrial, chemical, or emergency rescue worker.

BACKGROUND OF THE INVENTION

Commonly, a helmet for a firefighter or for an industrial, chemical, or emergency rescue worker has a crown and a brim, which projects forwardly from the crown and which may project in other directions from the crown. Commonly, the helmet is equipped with a pair of eye shields, one for each eye of a wearer, and each of the pair of eye shields is adapted to be manually moved between a storage position and a usage position. In the usage position, but not in the storage position, the eye shield projects downwardly so as to shield a given eye of a wearer against sparks, liquids, particles, and other objects striking the front of the eye shield.

An example of an eye shield, as described in the preceding paragraph, is disclosed in U.S. Pat. No. 3,383,155 to Lester T. Bourke. As disclosed in U.S. Pat. No. 3,383,155, the disclosure of which is incorporated herein by reference, each of the pair of eye shields is mounted to a helmet, beneath a brim projecting forwardly from a crown of the helmet, and each of the pair of eye shields is adapted to be manually flipped between the storage and usage positions and is stable in either of the storage and usage positions. Similar eye shields are available commercially from various sources including Morning Pride Manufacturing, L.L.C. of Dayton, Ohio.

SUMMARY OF THE INVENTION

This invention provides a helmet for a firefighter or for an industrial, chemical, or emergency rescue worker. The helmet, which has a crown and a brim projecting forwardly from the crown, is equipped with an eye shield, which is mounted to the helmet so as to be manually movable between a storage position and a usage position, and which, so mounted, in the usage position but not in the storage position, projects downwardly so as to shield at least one of the eyes of a wearer.

As provided by this invention, the eye shield is equipped with a face-conformable gasket, which is disposed along an outer edge of the eye shield and which is adapted to conform to the face of a wearer when the eye shield, so mounted, is moved into the usage position.

Preferably, the face-conformable gasket is made from an elastomeric material, such as neoprene, and has a grooved channel, into which the outer edge of the eye shield fits, and a bladder, to which the grooved channel is attached and which is adapted to conform to the face of a wearer when the eye shield, so mounted, is moved into the usage position.

If the helmet is equipped with a pair of eye shields, each of which is mounted to the helmet so as to be manually movable between a storage position and a usage position, and each of which, so mounted, in the usage position but not in the storage position, projects downwardly so as to shield an associated one of the eyes of a wearer, the pair of eye shields is equipped with a pair of face-conformable gaskets, each of which is disposed along an outer edge of an associated one of the pair of eye shields and each of which is adapted to conform to the face of a wearer when the associated one of the pair of eye shields, so mounted, is moved into the usage position.

Preferably, each face-conformable gasket is made from an elastomeric material, such as neoprene, and has a grooved channel, into which the outer edge of the associated one of the pair of eye shields fits, and a bladder, to which the grooved channel is attached and which is adapted to conform to the face of a wearer when the associated one of the pair of eye shields is moved into the usage position.

This invention also provides an eye shield, which is mountable to such a helmet, as described above, and which is equipped with a face-conformable gasket, as described above. The eye shield may be one of a pair of eye shields, each of which is mountable to such a helmet, as described above, and each of which is equipped with a face-conformable gasket, as described above.

Herein, directional terms, such as front and underside and such as forwardly and downwardly, are referenced to the vantage of a wearer standing erectly and looking forwardly.

DETAILED DESCRIPTION OF THE ILLUSTRATED EMBODIMENT

Figure 1:
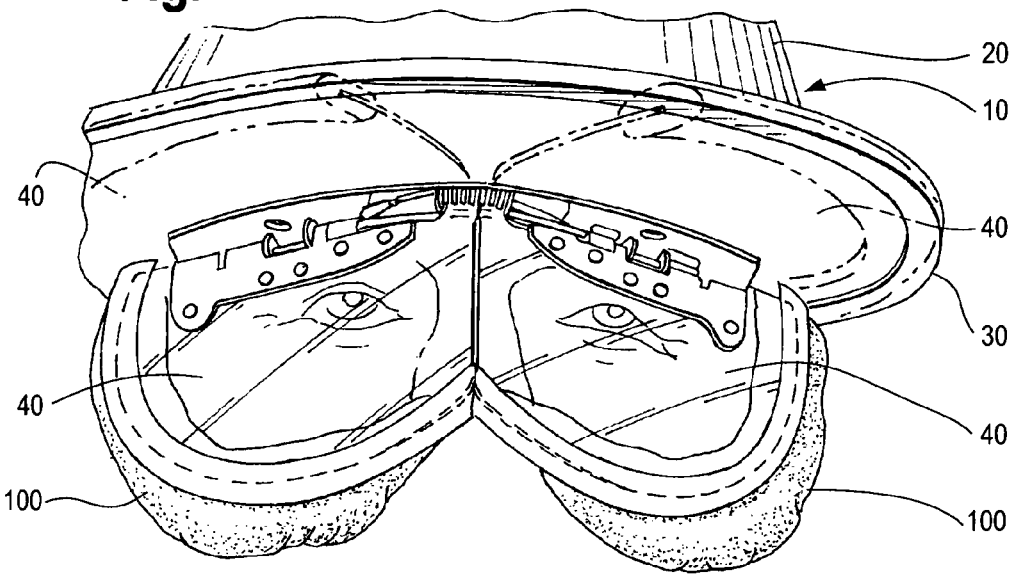
FIG. 1 is a fragmentary, pictorial view looking toward the front of a helmet equipped with a pair of eye shields, in flipped-down positions, and with a pair of face-conformable gaskets, in an embodiment of this invention.

As illustrated in FIG. 1, a helmet 10 worn by a firefighter has a crown 20, which is illustrated fragmentarily, and a brim 30, which projects forwardly and laterally from a lower edge of the crown 20. The helmet 10 is equipped with a pair of eye shields 40, which are made from a transparent, shatter-resistant, polymeric material, such as polycarbonate. The shields 40 are mounted to the underside of the brim 30 where the brim 30 project forwardly, via hinges, springs, and other elements, as disclosed in U.S. Pat. No. 3,383,155, supra, so as to be manually flippable between a storage position and a usage position.

Figure 2:
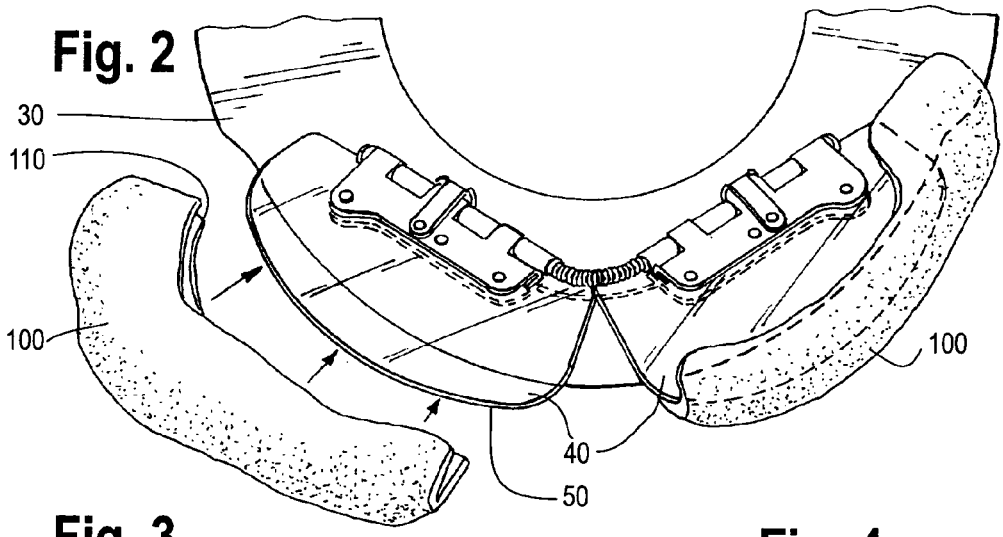
FIG. 2 is a partly exploded, fragmentary, pictorial view looking toward the underside of the helmet, the pair of eye shields, in flipped-up positions, and the pair of face-conformable gaskets.
Figure 3:
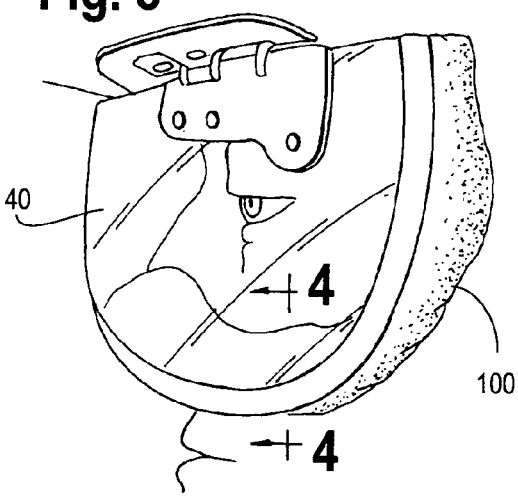
FIG. 3 is a fragmentary, pictorial view looking toward one side of one of the pair of eye shields, in a flipped-down position, and one of the pair of face-conformable gaskets.
Figure 4:
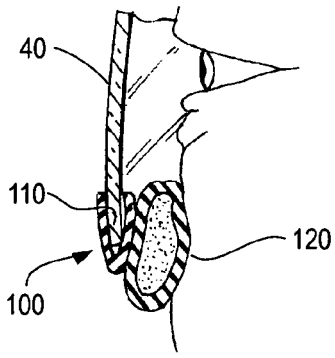
FIG. 4 is a fragmentary section view taken from line 4-4 in FIG. 3.

In FIG. 1, the shields 40 are illustrated in the storage position, in broken lines, and in the usage position, in full lines. In FIG. 2, the shields 40 are illustrated in the storage position, in full lines. In the storage position, each shield 40 projects forwardly, beneath the brim 30 where the brim 30 project forwardly. In the usage position, but not in the storage position, each shield 40 shields an associated one of the eyes of the wearer against sparks, liquids, particles, and other objects striking the front of said shield 40.

As provided by this invention, the helmet 10 is equipped with a pair of face-conformable gaskets 100. Each face-conformable gasket 100 is disposed along an outer edge 50 of an associated one of the pair of eye shields 40. Each face-conformable gasket 100 is adapted to conform to the face of a wearer when the associated one of the pair of eye shields 40 is moved into the usage position.

Each face-conformable gasket 100 is made from an elastomeric material, such as neoprene. Each face-conformable gasket 100 and has a grooved channel 110, into which the outer edge 50 of the associated one of the pair of eye shields 40 fits tightly but, preferably, removably. Alternatively, the outer edge 50 of the associated one of the pair of eye shields 40 may be adhesively and permanently secured in the grooved channel 110.

Each face-conformable gasket 100 has a bladder 120, which is gel-filled, gas-filled, or liquid-filled. The grooved channel 110 of each face-conformable gasket 100 is attached adhesively, via welding, or otherwise to the bladder 120 of said face-conformable gasket 100. The bladder 120 of each face-conformable gasket 100 is adapted to conform to the face of a wearer, between the nose of the wearer and an associated one of the ears of the wearer, when the associated one of the pair of eye shields 40 is moved into the usage position.

When each shield 40 is flipped into the usage position with its outer edge 50 fitted tightly into the channel of the associated one of the face-conformable gaskets 100, each face-conformable gasket 100 shields an associated one of the eyes of the wearer and an adjacent area of the face of the wearer against sparks, liquids, particles, and other objects striking said face-conformable shield 100.

The invention claimed is:

1. For a firefighter or for an industrial, chemical, or emergency rescue worker, a helmet having a crown and having a brim projecting forwardly from the crown, the helmet being equipped with an eye shield, which is pivotably mounted to the helmet forward of the crown so as to be manually pivoted about an axis forward of the crown between a storage position extending along and under the brim and a usage position extending downwardly so as to shield at least one of the eyes of a wearer, the eye shield being equipped with a face-conformable gasket, which is disposed along an outer edge of the eye shield and which is adapted to conform to the face of a wearer when the eye shield, so mounted, is moved into the usage position wherein the face-conformable gasket has a grooved channel, into which the outer edge of the eye shield fits.

2. The helmet of claim 1, wherein the face-conformable gasket is made from an elastomeric material.

3. The helmet of claim 1, wherein the face-conformable gasket has a bladder, to which the grooved channel is attached and which is adapted to conform to the face of a wearer when the eye shield is moved into the usage position.

4. For a firefighter or for an industrial, chemical, or emergency rescue worker, a helmet having a crown and having a brim projecting forwardly from the crown, the helmet being equipped with a pair of eye shields, each of which is pivotably mounted to the helmet forward of the crown so as to be manually pivoted about an axis forward of the crown between a storage position extending along and under the brim and a usage position extending downwardly so as to shield an associated one of the eyes of a wearer, the helmet being equipped with a pair of face-conformable gaskets, each of which is disposed along an outer edge of an associated one of the eye shields and each of which is adapted to conform to the face of a wearer when the associated one of the eye shields, so mounted, is moved into the usage position wherein each face-conformable gasket has a grooved channel, into which the outer edge of the associated one of the eye shields fits.

5. The helmet of claim 4, wherein each face-conformable gasket is made from an elastomeric material.

6. The helmet of claim 4, wherein each face-conformable gasket has a bladder, to which the grooved channel of said face-conformable gasket is attached and which is adapted to conform to the face of a wearer when the associated one of the eye shields, so mounted, is moved into the usage position.

7. For a firefighter or for an industrial, chemical, or emergency rescue worker, an eye shield, which is pivotably mountable to a forwardly projecting brim of a helmet having a crown so as to be manually pivoted about an axis forward of the crown between a storage position extending along and under the brim and a usage position downwardly so as to shield at least one of the eyes of a wearer, the eye shield being equipped with a face-conformable gasket, which is disposed along an outer edge of the eye shield and which is adapted to conform to the face of a wearer when the eye shield, so mounted, is moved into the usage position wherein the face-conformable gasket has a grooved channel, into which the outer edge of the eye shield fits.

8. The eye shield of claim 7, wherein the face-conformable gasket is made from an elastomeric material.

9. The eye shield of claim 7, wherein the face-conformable gasket has a bladder, to which the grooved channel is attached and which is adapted to conform to the face of a wearer when the eye shield is moved into the usage position.

10. For a firefighter or for an industrial, chemical, or emergency rescue worker, a pair of eye shields, each of which is pivotably mountable to a forwardly projecting brim of a helmet having a crown so as to be manually pivoted about an axis forward of the crown between a storage position extending along and under the brim and a usage position extending projects downwardly so as to shield an associated one of the eyes of a wearer, the pair of eye shields being equipped with a pair of face-conformable gaskets, each of which is disposed along an outer edge of an associated one of the eye shields and each of which is adapted to conform to the face of a wearer when the associated one of the eye shields, so mounted, is moved into the usage position wherein each face-conformable gasket has a grooved channel, into which the outer edge of the associated one of the eye shields fits.

11. The pair of eye shields of claim 10, wherein each face-conformable gasket is made from an elastomeric material.

12. The pair of eye shields of claim 10, wherein each face-conformable gasket has a bladder, to which the grooved channel of said face-conformable gasket is attached and which is adapted to conform to the face of a wearer when the associated one of the eye shields, so mounted, is moved into the usage position.

13. For a firefighter or for an industrial, chemical, or emergency rescue worker, a helmet having a crown and having a brim projecting forwardly from the crown, the helmet being equipped with a pair of eye shields, each of which is pivotably mounted to the helmet forward of the crown so as to be manually pivoted about an axis forward of the crown between a storage position extending along and under the brim and a usage position extending downwardly so as to shield an associated one of the eyes of a wearer, the helmet being equipped with a pair of face-conformable gaskets, each of which is disposed along an outer edge of an associated one of the eye shields and each of which is adapted to conform to the face of a wearer when the associated one of the eye shields, so mounted, is moved into the usage position wherein each of the eye shields is mounted to pivot about a pivot axis that extends nonparallel to the pivot axis of the other eye shield.

14. For a firefighter or for an industrial, chemical, or emergency rescue worker, a pair of eye shields, each of which is pivotably mountable to a forwardly projecting brim of a helmet having a crown so as to be manually pivoted about an axis forward of the crown between a storage position extending along and under the brim and a usage position extending projects downwardly so as to shield an associated one of the eyes of a wearer, the pair of eye shields being equipped with a pair of face-conformable gaskets, each of which is disposed along an outer edge of an associated one of the eye shields and each of which is adapted to conform to the face of a wearer when the associated one of the eye shields, so mounted, is moved into the usage position wherein each of the eye shields is mounted to pivot about a pivot axis that extends nonparallel to the pivot axis of the other eye shield.

* * * * *